United States Patent [19]

Berney

[11] Patent Number: 4,595,130

[45] Date of Patent: Jun. 17, 1986

[54] REVERSIBLE POURING SPOUT ASSEMBLY FOR CONTAINERS

[75] Inventor: Sheldon Berney, Winnipeg, Canada

[73] Assignee: Reliance Products Ltd., Winnipeg, Canada

[21] Appl. No.: 638,358

[22] Filed: Aug. 6, 1984

[30] Foreign Application Priority Data

Jan. 23, 1984 [AU] Australia ..... PG3297

[51] Int. Cl.[4] ..... B65D 25/50; B67D 3/00

[52] U.S. Cl. ..... 222/539; 222/189; 222/543; 222/568

[58] Field of Search ..... 222/189, 460, 461, 530, 222/539, 543, 545, 567, 568, 538

[56] References Cited

U.S. PATENT DOCUMENTS

| | | | |
|---|---|---|---|
| 242,704 | 6/1881 | Smalley | 222/539 X |
| 513,893 | 1/1894 | Davenport | 222/189 |
| 1,387,211 | 8/1921 | Sweeny | 222/539 |
| 1,616,644 | 2/1927 | Wedge | 222/189 |
| 2,171,302 | 8/1939 | Conner | 222/539 |
| 2,370,668 | 3/1945 | Johnson | 222/189 |
| 2,534,434 | 12/1950 | Gersten | 222/539 |
| 2,601,039 | 6/1952 | Livingstone | 222/570 |
| 2,620,093 | 12/1952 | Rose | 222/543 |
| 2,947,453 | 8/1960 | Parish | 222/539 |

*Primary Examiner*—Joseph J. Rolla
*Assistant Examiner*—Edward S. Ammeen
*Attorney, Agent, or Firm*—Stanley G. Ade

[57] ABSTRACT

A reversible filler spout assembly is sealably engaged with the filler neck when in the pouring position by camming surfaces on the spout inner end and on the distal end of the filler neck. When reversed and inserted into the neck for storage, the closure cap engages the filler neck and clamps a horizontal flange on the spout between the interior of the cap and the upper end of the neck with resilient seals between the cap and spout and between the spout and filler neck so that no leakage can occur.

10 Claims, 11 Drawing Figures

REVERSIBLE POURING SPOUT ASSEMBLY FOR CONTAINERS

BACKGROUND OF THE INVENTION

This invention relates to new and useful improvements in reversible pouring assemblies for containers, particularly containers made form synthetic plastic although the invention is not limited to such synthetic plastic containers.

Conventionally, plastic containers are well known for containing water, gasoline and other liquids and it is of course a requirement that such containers be sealed when not in use yet provide access for the attachment of a pouring spout when it is desired to dispense all or part of the contents therefrom.

Difficulty is experienced firstly, in storing the pouring spout and secondly, to ensure that an adequate seal is provided both when the container is sealed and when the spout is attached for the pouring action.

Many such containers include a pouring spout which may be stored internally of the container with the sealing cap maintaining the spout in the stored position. The cap and spout are removed when it is desired to pour the contents whereupon the spout is reversed and engaged through the cap which is apertured so that it extends outwardly therefrom. The cap is then screw threadably engaged upon the pouring neck thus clamping the spout in sealing relationship with the can and allowing the pouring action to commence.

When it is desired to store such spouts within the container, the cap and spout are removed, the spout is reversed and engaged through the pouring neck of the container, to be stored internally with the flange of pouring spout engaging the outer end of the neck. However in order to seal the container, a blank disc is then engaged within the end of the pouring spout whereupon the apertured cap may be screw threadably engaged over the neck so that the blank disc seals against the spout and the wall of the cap defining the aperture. One of the principal disadvantages of such construction is the fact that the disc has to be removed when it is desired to pour and although the cap may be tethered to the container, it is not possible to tether the disc also so that it often becomes mislaid, dirt incrusted and is generally most unsuitable for use in the majority of circumstances.

SUMMARY OF THE INVENTION

The present invention overcomes these disadvantages by providing a reversible pouring spout which, when in the pouring position, is detachably securable to the neck of the container and is sealed thereto without the necessity of using an apertured cap.

When the spout is in the stored position within the container, the cap, which is closed on the upper side thereof, engages the pouring neck in sealed relationship thus holding the spout in the stored position and preventing any leakage from occurring. This construction eliminates the necessity for the loose blank disc or other means normally provided to enable such reversible spouts to operate.

In accordance with one aspect of the invention there is provided, in a container which includes a substantially cylindrical pouring neck extending therefrom; a reversible pouring spout assembly selectively movable from an extended, pouring position to an internal, stored position and vice versa, said spout assembly including a pouring neck attaching end and an extending pouring spout portion, means cooperating between said spout assembly and said pouring neck to detachably secure said spout assembly in sealing relationship with said pouring neck when in the extended pouring position, and a closure cap detachably engaging with said neck and retaining said spout assembly in the internal stored position, in sealing relationship with said pouring neck and said closure cap.

In accordance with a further aspect of the invention there is provided a combination of a container and a reversible pouring spout assembly, said container including a substantially cylindrical pouring neck extending therefrom said reversible pouring spout assembly being selectively movable from an extended pouring position to an internal stored position and vice versa, means cooperating between said spout assembly and said pouring neck to detachably secure said spout assembly in sealing relationship with said pouring neck when in the extended pouring position, and a closure cap detachably engaging with said neck and retaining said spout assembly in the internal stored position, in sealing relationship with said pouring neck and said closure cap.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Proceeding therefore to describe the invention in detail, reference should first be made to FIGS. 1 through 4 in which 10 illustrates in phantom, the upper portion of a container for fluids and the like which includes a substantially cylindrical neck 11 extending from a planar portion 12 and being screw threaded as at 13, on the outer surface thereof.

Figure 6:
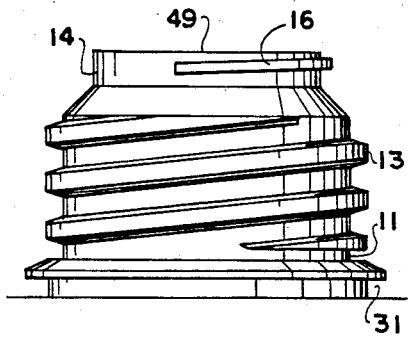
FIG. 6 is an enlarged side elevation of the pouring neck per se.
Figure 7:
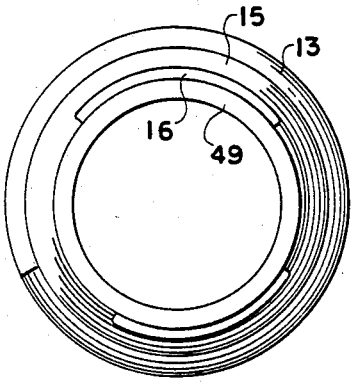
FIG. 7 is a top plan view of FIG. 6.
Figure 8:
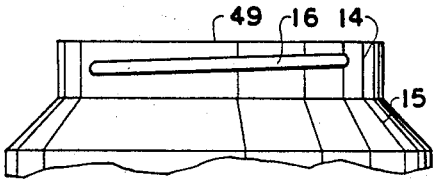
FIG. 8 is a fragmentary side elevation of the upper portion of FIG. 6 taken at 90° thereto.
Figure 9:
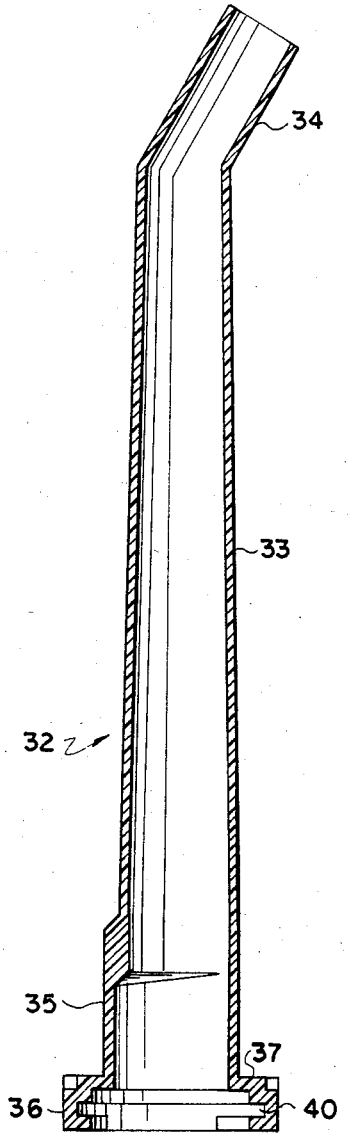
FIG. 9 is a longitudinal cross section of the spout filter.

The distal end 14 of the pouring neck is of a reduced diameter to the remaining portion of the neck, and connected thereto by means of the truncated conical connecting portion 15. Details of this pouring neck are shown in FIGS. 6 and 7 and formed on the distal end portion are a pair of camming surfaces 16 diametrically opposite from one another and extending part way around the distal end portion 14 as clearly shown, the purpose of which will hereinafter be described.

Figure 5:
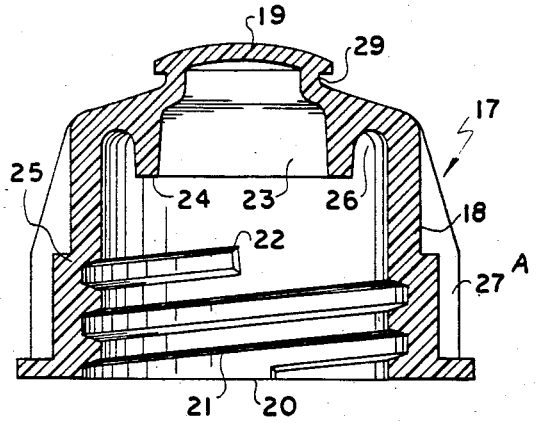
FIG. 5 is an enlarged cross sectional view of the cap per se.

A sealing cap component collectively designated 17 is shown in detail in FIG. 5 and is also preferably made of plastic. It includes the substantially cylindrical body 18 having a closed one end 19 and an open other end 20. The portion of the cylindrical body 18 adjacent the open end 20 is internally screw threaded as indicated by reference character 21 with the screw threading terminating at a point indicated by reference character 22. Extending downwardly from the interior of the domed portion 19A of the cap, is an annular cylindrical flange 23 terminating at a point indicated by reference character 24 spaced above the inner ends of the screw threads indicated at 22. This annular flange 23 is spaced inwardly from the wall 25 thus defining, with the wall 25, an annular channel 26 all of which is clearly shown in FIG. 5.

A plurality of projections 27A are provided around the exterior of the cap in order to assist in the manual gripping thereof when same is being manipulated. The cap screw threadably engages the neck 11 with the screw threads 21 engaging the screw threads 13.

A flexible tether 27 includes a loop 28 at one end engaging an annular groove 29 adjacent the upper side 19 of the cap and having a further loop 30 engaging an annular groove 31 around the base of the pouring neck 11 thus permitting the cap to be rotated freely yet anchoring same to the container 10.

A reversible pouring spout is provided collectively designated 32 and also preferably made from plastic. It includes an elongated tapered pouring portion 33 with an angulated discharge end 34 formed on the distal end thereof.

The inner or container contacting end 35 includes an annular cylindrical portion 36 connected to the end 35 by means of a planar shoulder 37 and inner and outer resilient gaskets 38 and 39 are provided upon either side of this planar shoulder 37 as clearly shown in FIGS. 3 and 4 and secured as hereinafter described.

Figure 10:
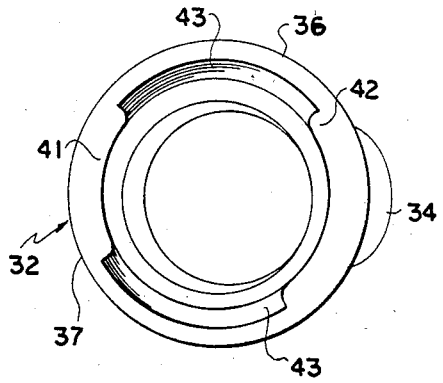
FIG. 10 is an underside plan view of FIG. 9.

A pair of arcuately curved recesses 40 are formed diametrically opposite one another on the inner surface of the cylindrical portion 36, the extent being defined by the ends 41 of the lower lips 42 defining these recesses (see FIG. 10). The remaining portion of the circle upon which these recesses lie, is open as indicated by reference character 43, the purpose of which will hereinafter be described.

Figure 1:
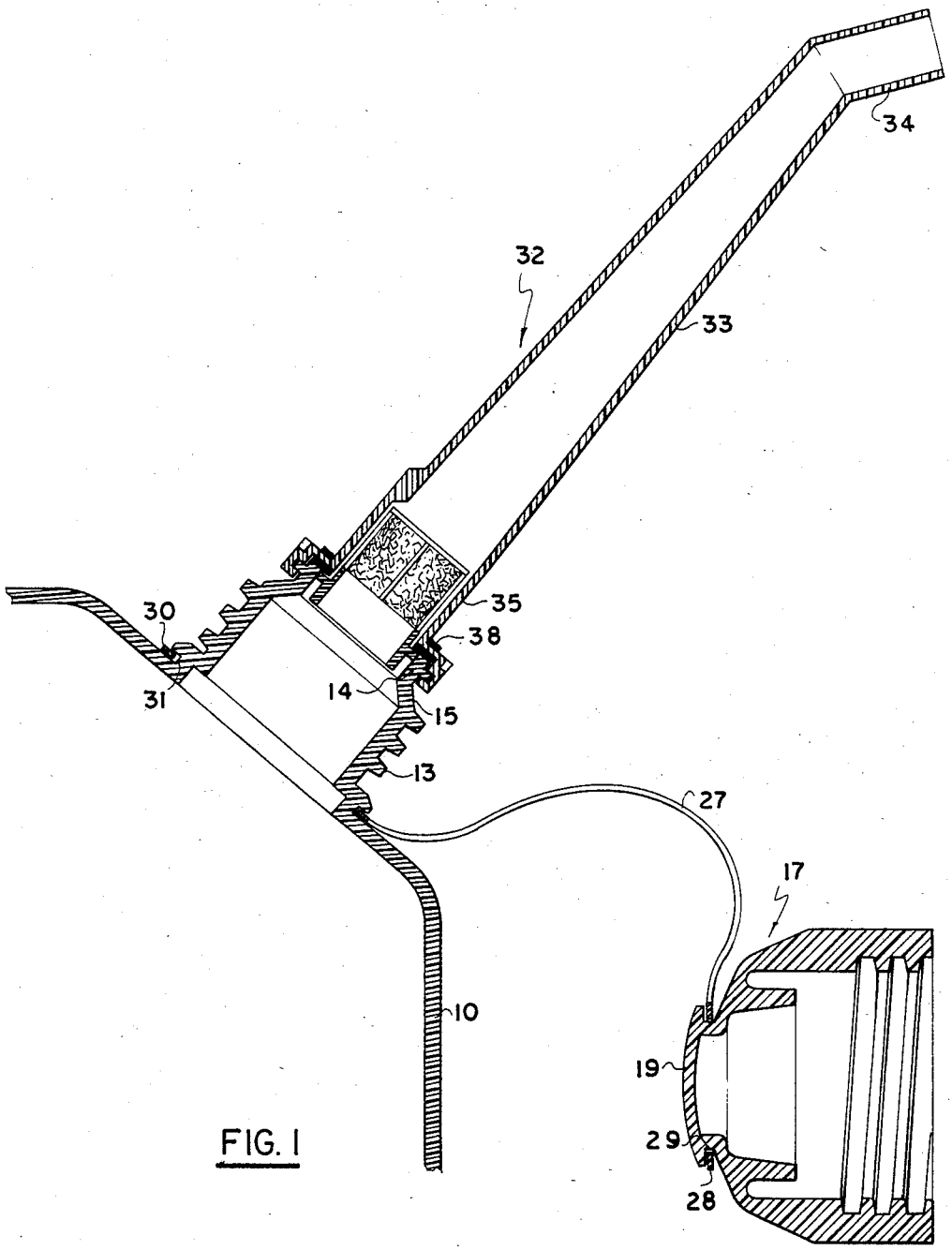
FIG. 1 is a fragmentary cross sectional view showing the pouring neck of a container with the spout secured thereto in the pouring position.
Figure 2:
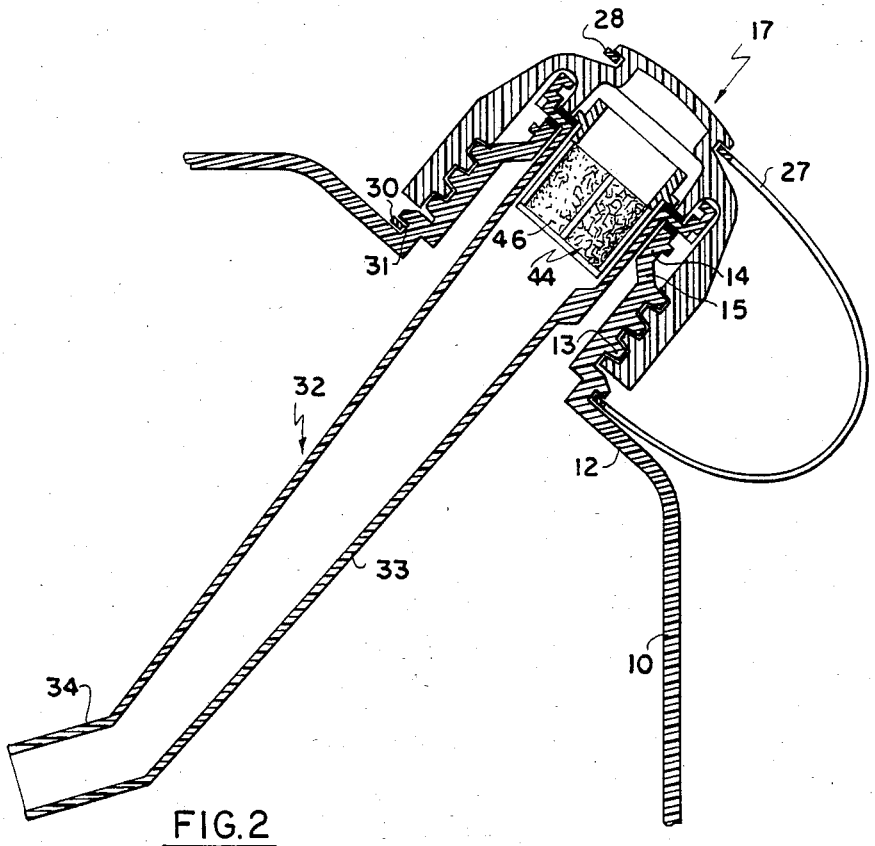
FIG. 2 is a view similar to FIG. 1 but showing the spout in the sorted position within the container and the cap engaged over the filler neck.
Figure 3:
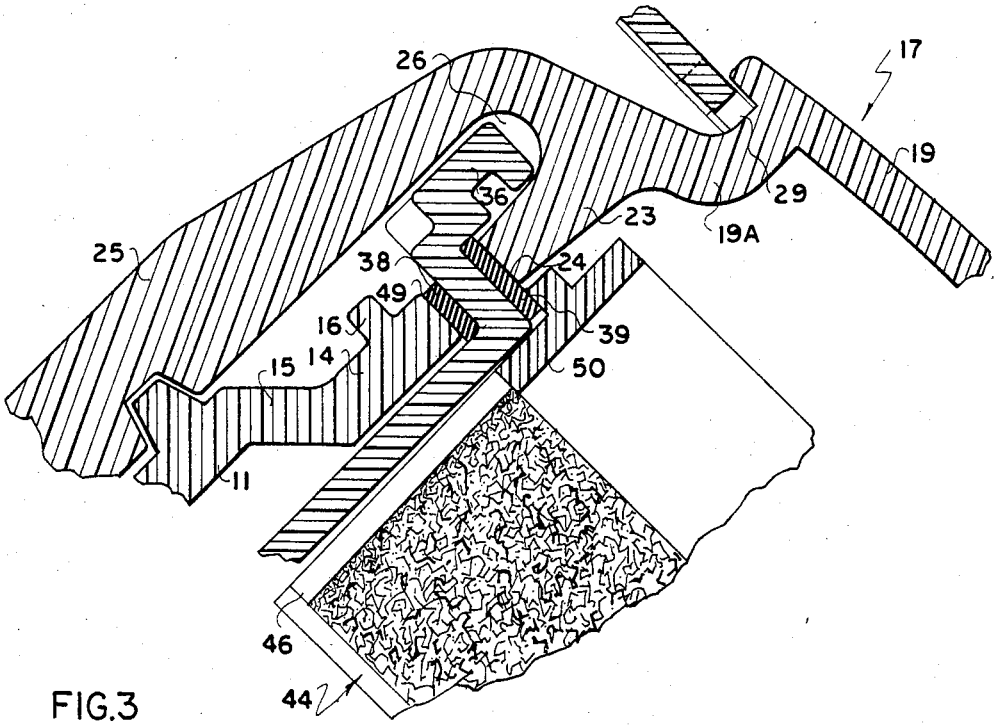
FIG. 3 is an enlarged fragmentary view of the one side of the spout and cap engaged with the neck as in FIG. 2.
Figure 4:
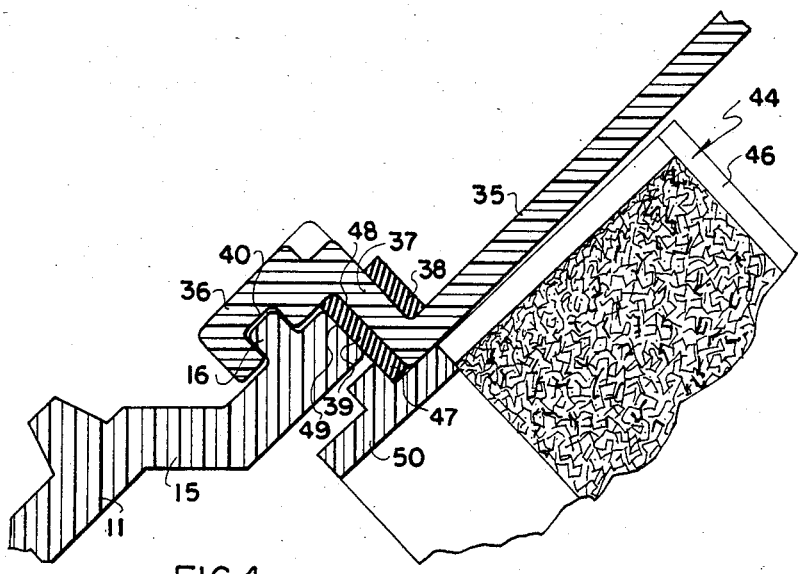
FIG. 4 is an enlarged fragmentary view of a similar portion of FIG. 1 as that shown in FIG. 3.
Figure 11:
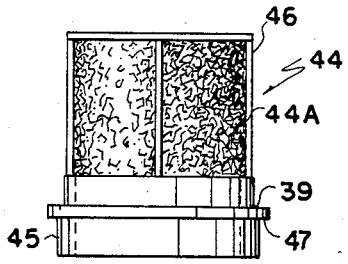
FIG. 11 is a side elevation of the filter retainer and filter per se.

A cylindrical filter retainer (see FIG. 11) collectively designated 44 is frictionally engaged within the end portion 35 of the pouring spout and includes a cylindrical body portion 45, an inner end spider 46 spanning the inner end of the cylindrical portion 45 and an annular shoulder 47 formed on the outer end which abuts against the surface 48 which is an inner continuation of the flange 37 all of which is clearly shown in FIGS. 3 and 4. The filter element in the form of plug 44A is preferably made from open celled, sponge type plastic, and fits within the retainer as seen in FIGS. 1 and 2.

Gasket 39 engages around the shouldered cylindrical portion 36 and registers on shoulder 47. Gasket 38 engages around end 35 of the spout and registers on shoulder 37. These gaskets are frictionally engaged and retained or may be adhesively secured to each side of the shoulder 47.

In operation and dealing first with the spout in the stored position shown in FIGS. 2 and 3, the portions 33 and 34 are engaged freely through the filler neck 11 until the resilient seal 38 engages the upper end wall 49 of the portion 14 of the filler neck as clearly shown in FIG. 3 with the remaining portion 36 of the filler spout assembly projecting above the end 49. The outer portion 50 of the filter retainer 44 is substantially flush with the end 49.

The sealing cap 17 is then screw threadably engaged over the filler neck and rotated to move same downwardly over the filler neck until the surface 24 of the annular flange 23 of the filler neck engages upon the sealing washer 39 whereupon a slight further tightening of the cap will compress the sealing washer 39 and also the sealing washer 38 thus completely sealing the interior of the can from the exterior thereof. In this connection, sealing washer 38 seals between the spout and the neck and the sealing washer 39, between the cap and the spout.

Reference to FIG. 3 will show that the portion 36 of the spout is freely engaged within the annular recess 26 in the filler cap and the portion 50 of the filter retainer is freely engaged within the area inboard of the annular shoulder 23 of the cap.

When it is desired to change the pouring spout assembly 32, from the stored position to the pouring position, then the cap is rotated and removed from the filler neck to remain connected to the container by means of the tether 27.

The pouring spout component 32 is then withdrawn from the container and reversed and engaged upon the upper end of the filler neck 11 by positioning the annular areas 43 of the filler spout over the camming ramps 16 on the upper end portion 14 of the filler neck. The filler spout is then partially rotated thus engaging the camming ramps with the recesses 40 of the filling camming ramps, this partial rotation draws the filler neck downwardly until the resilient sealing ring 39 on the portion 35 of the pouring spout engages the upper end wall 49 of the filler neck thus effecting a seal at this point between the interior of the can and the exterior of the filling neck. This allows the contents of the can to be poured through the pouring spout without any leakage occurring at the sealed junction therebetween. It will be observed from FIG. 4 that the extending portion 50 of the filter retainer freely engaged within the upper end portion 14 of the filler neck.

It will therefore be appreciated that a reversible spout assembly is provided which is sealed in either position and without requiring a loose blank washer or disc as is conventional.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. The combination of a container and a revesible pouring spout assembly, said container including a substantially cylindrical pouring neck extending therefrom, said reversible pouring spout assembly being selectively movable from an extended pouring position of an internal stored position and vice versa, said spout assembly including a pouring neck attaching end and an extending pouring spout portion, means cooperating between said spout assembly and said pouring neck to detachably secure said spout assembly in sealing relationship with said pouring neck when in the extended pouring position, a closure cap detachably engaging with said neck and further independent means cooperating between said cap and said neck to detachably secure said cap to said neck for retaining said spout assembly in the internal stored position, in sealing relationship with said pouring neck and said closure cap and also closing said container regardless of the presence of said spout assembly, said means cooperating between said spout assembly and said pouring neck as aforesaid, including said attaching end engaging over said pouring neck and camming means cooperating between the outer side of said pouring neck and the inner side of said attaching end for moving said attaching end into sealing relationship with the outer end of said pouring neck and sealing means between said attaching end and said outer end.

2. The invention according to claim 1 in which said camming means includes at least two camming surfaces extending outwardly from the side wall of said pouring neck and being substantially equidistantly spaced circumferentially around said side wall and corresponding recesses on the inner wall of said attaching end of said pouring spout assembly engaging said camming surfaces.

3. The invention according to claim 2 in which said attaching end includes an annular flange extending radially outwardly from said pouring spout portion and an annular wall extending substantially at right angles from the outer edge of said annular flange in a direction away from said pouring spout portion, and inner lip portions extending inwardly from the outer end of said annular wall defining, with said annular flange, recesses engageable upon said camming surfaces.

4. The invention according to claim 3 in which said sealing means engages between said annular flange and the outer end wall of said pouring neck.

5. The invention according to claim 1 in which said further independent means cooperating between said cap and said neck include said closure cap screw threadably engaging said pouring neck when said spout assembly is in the inward stored position and means within said closure cap for clamping said pouring spout assembly in said sealed relationship between said closure cap and the outer end of said pouring neck.

6. The invention according to claim 5 in which said means within said closure cap includes an annular cylindrical flange depending downwardly, concentrically from said closed end and spaced inwardly from the surrounding wall of said closure cap and thus defining an annular recess or cavity between said cylindrical flange and said surrounding wall, said cylindrical flange terminating spaced inwardly from the open end of said closure cap, the distal end of said cylindrical flange cooperatively engaging said pouring neck attaching end of said spout assembly and clamping same in sealing relationship to said pouring neck.

7. The invention according to claim 6 in which said attaching end of said pouring spout assembly includes an annular flange extending radially outwardly from said pouring spout assembly and an annular wall extending substantially at 90° from the outer edge of said flange assembly away from said pouring spout portion of said spout assembly, sealing means on each side of said annular flange of said attached end, one between said annular flange and the outer end of said pouring neck, the other between said annular flange and the distal end of said cylindrical flange of said closure cap, said annular wall of the attaching end of said pouring spout assembly engaging freely within the annular recess or cavity between said cylindrical flange and said surrounding wall of said closure cap whereby tightening of said closure cap upon said pouring neck clamps the said annular flange of said attaching end of said pouring spout assembly between said closure cap and the outer end of said pouring neck.

8. The invention according to claim 1 which includes a detachable filter component within said attaching end of said pouring spout assembly.

9. The invention according to claim 8 in which said filter component includes a cylindrical filter retainer frictionally engageable within said attaching end and including a cylindrical body portion and a filter element held within said body portion.

10. The invention according to claim 9 in which said filter component include a cylindrical filter retainer frictionally engageable within said attaching end and including a cylindrical body portion and a filter element held within said body portion and an annular shoulder on the outer end of said body portion abutting against the inner portion of the outer sealing means on said annular flange of the attaching end of the pouring spout assembly.

* * * * *